US005667064A

United States Patent [19]

Bauman

[11] Patent Number: 5,667,064

[45] Date of Patent: Sep. 16, 1997

[54] SKETCHBOOK ORGANIZER

[76] Inventor: Annette L. Bauman, 3609 W. Viewmont Way W., Seattle, Wash. 98199

[21] Appl. No.: 686,130

[22] Filed: Jul. 23, 1996

[51] Int. Cl.[6] ..... B65D 63/10

[52] U.S. Cl. ..... 206/214; 206/232; 206/575; 206/805; 281/37; 402/73

[58] Field of Search ..... 206/214, 575, 206/224, 371, 232, 424, 472, 473, 805; 281/37, 29, 31; 402/73

[56] References Cited

U.S. PATENT DOCUMENTS

| | | | |
|---|---|---|---|
| Re. 22,417 | 1/1944 | Hassenfeld | 206/575 |
| 1,218,849 | 3/1917 | Frederickson | 206/214 |
| 3,823,814 | 7/1974 | Lum | 206/232 |
| 4,832,191 | 5/1989 | Gerver et al. . | |
| 4,986,572 | 1/1991 | Kuykendall . | |
| 5,054,816 | 10/1991 | Rosengarten | 281/42 |
| 5,232,301 | 8/1993 | Bianco | 402/73 |
| 5,234,108 | 8/1993 | Jorgensen . | |
| 5,325,959 | 7/1994 | Goldberger | 206/472 |
| 5,350,061 | 9/1994 | Gunn . | |

*Primary Examiner*—Jimmy G. Foster
*Assistant Examiner*—Luan K. Bui
*Attorney, Agent, or Firm*—Dean A. Craine

[57] ABSTRACT

A durable, economical to manufacture organizer for a sketchbook designed to store and carry various drawing instruments used by the artist which directly attaches to the sketchbook. The organizer includes a container which selectively attaches to a leaf on a sketchbook and allows the sketchbook to be opened or closed while the organizer is attached to the sketchbook. The container has a flap member which folds and slides between the leaf of the book and the drawing pages in the sketchbook. Hook and loop connector pads and an elastic strap are provided to hold the container over the front surface of the leaf. A lid is attached to the container which may be selectively closed during use. The organizer is made from a single template made of durable material which is easily folded into the container. Suitable connectors are used to hold the walls and parts of the container together.

6 Claims, 5 Drawing Sheets

SKETCHBOOK ORGANIZER

BACKGROUND OF THE INVENTION

1. Field of the Invention

This invention relates to books and, more particularly, to elements or accessories attached thereto.

2. Description of the Related Art

Artists often carry sketchbooks with them in which they draw various objects or scenes they contemplate or observe when traveling. Typically, sketchbooks come in various sizes and include 50 to 250 blank sheets of drawing paper bound at one edge between front and back hard covers or leaves. The front and back leaves protect the sheets of drawing paper from moisture, sunlight and abrasion.

Because the sketchbooks are used outside a studio, various drawing equipment, such as pens, pencils, rulers, erasers, etc., must be carried by the artist. Typically, this equipment is carried in the artist's pockets or in a separate pouch or folder. Ideally, an organizer is needed for protecting and carrying this equipment that can be conveniently attached directly to the sketchbook without modifying or damaging the sketchbook. Such an organizer should also allow the sketchbook opened and closed without having to remove the organizer from the sketchbook. Also, such an organizer should be sufficiently durable and inexpensive to manufacture.

SUMMARY OF THE INVENTION

It is an object of the invention to provide an organizer designed to protect and carry drawing equipment.

It is another object of the invention to provide such an organizer that can be selectively attached and removed from a sketchbook without modifying or damaging the sketchbook.

It is a further object of the invention to provide such an organizer that enables the sketchbook to be opened and closed when the organizer is attached thereto.

It is a still further object of the invention to provide such an organizer that is sufficiently durable and inexpensive to manufacture.

These and other objects are met by providing an organizer including a square or rectangular-shaped container having two parallel side walls, two parallel end walls, a planar back wall, a short front wall, and a closable lid. The side walls, end walls, back wall, and short front wall are attached together to form a partially closed structure.

Attached to one side wall of the container is a flap member which folds under the container and slides between the leaf of a sketchbook and the pages of drawing paper contained therein. A flap member attachment means is provided which is used to securely attach the flap member directly to the inside surface of the leaf. Attached or integrally formed on the opposite side of the container is an inside support panel which, during assembly is folded directly under the container and inside the flap member. When the organizer is attached to a sketchbook, the inside support panel is positioned against the outside surface of the leaf. An elastic strap is also provided which, during assembly, loops around the inside support panel, the adjacent leaf, and the flap member to securely hold the container on the leaf. Disposed between the closable lid and the short front wall on the container is a lid closing means which is used to selectively close the lid on the container during transport.

An optional divider is also provided inside the container which creates two separate compartments therein. The divider is also used to interconnect the middle portion of the inside support panel with the container which provides further support thereto.

In the embodiment shown herein, the organizer is constructed from a single planar template made of durable, lightweight material, such a thick paper or vinyl material. During assembly, sections of the template are selectively folded along foldlines created on the template. Suitable connectors are then used to selectively interconnect sections of the template together to form the above described container. By constructing the container from a single template, the cost of manufacturing and assembling the container is relatively low thereby making the organizer a suitable replacement for other types of pouches or folders.

DESCRIPTION OF THE PREFERRED EMBODIMENT(S)

Figure 1:
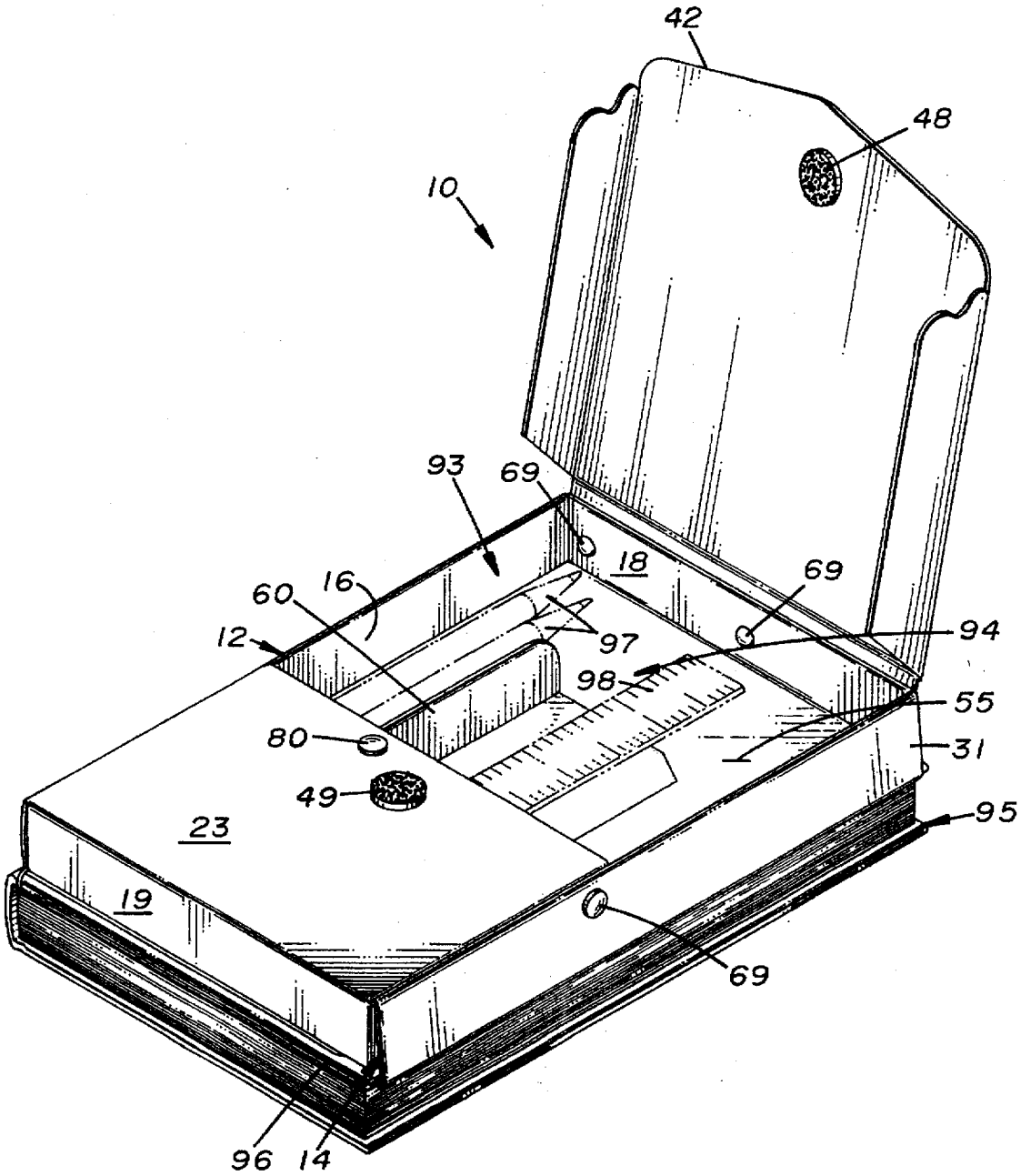
FIG. 1 is a perspective view of the invention disclosed herein.
Figure 2:
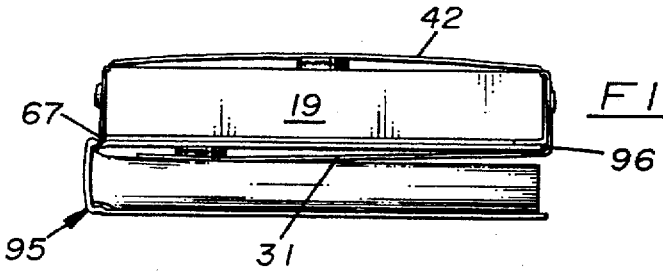
FIG. 2 is an end elevational view of the invention.
Figure 3:
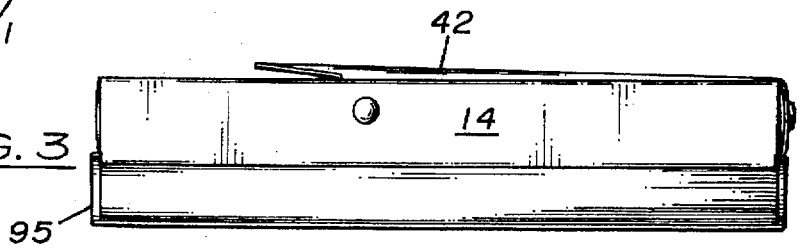
FIG. 3 is a side elevational view of the invention.
Figure 4:
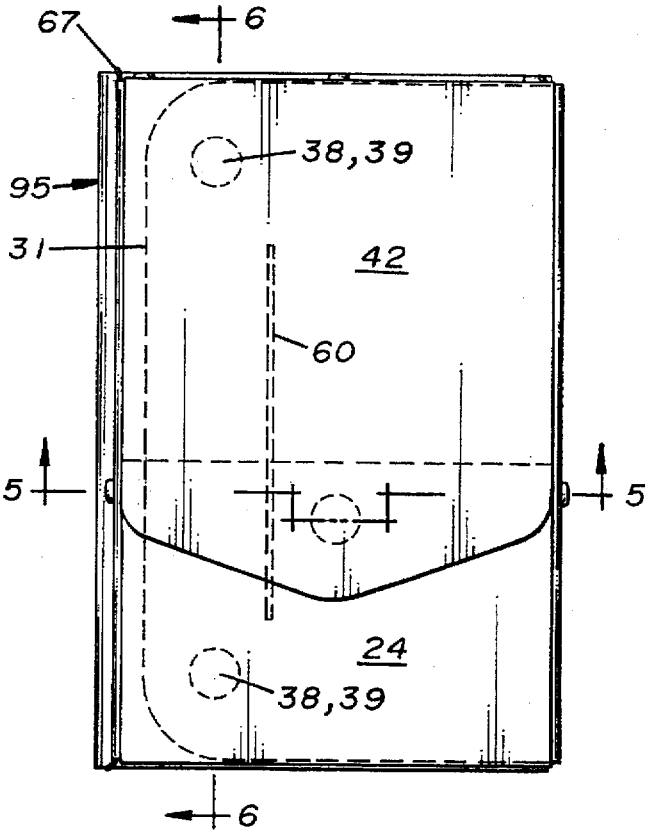
FIG. 4 is a top plan view of the invention.
Figure 5:
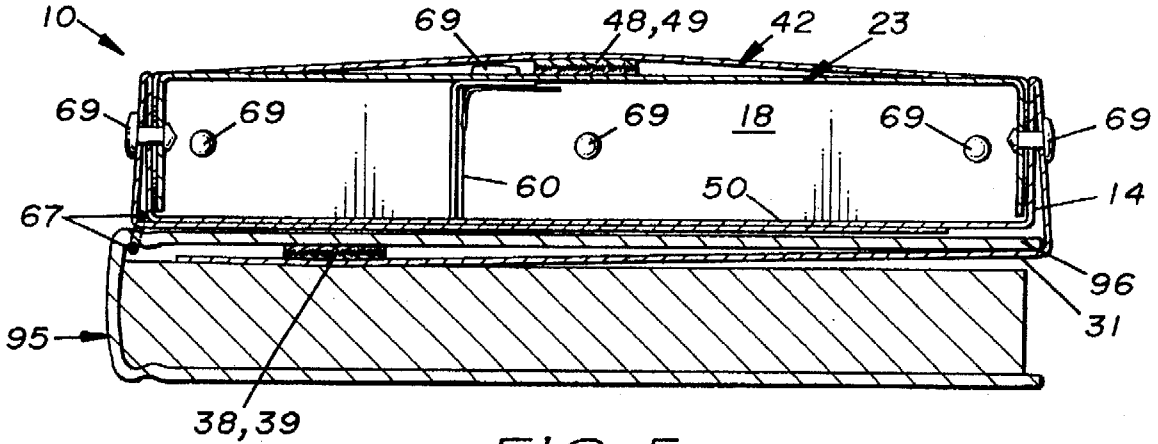
FIG. 5. is a sectional, end view of the invention taken along line 5—5 in FIG. 4.
Figure 6:
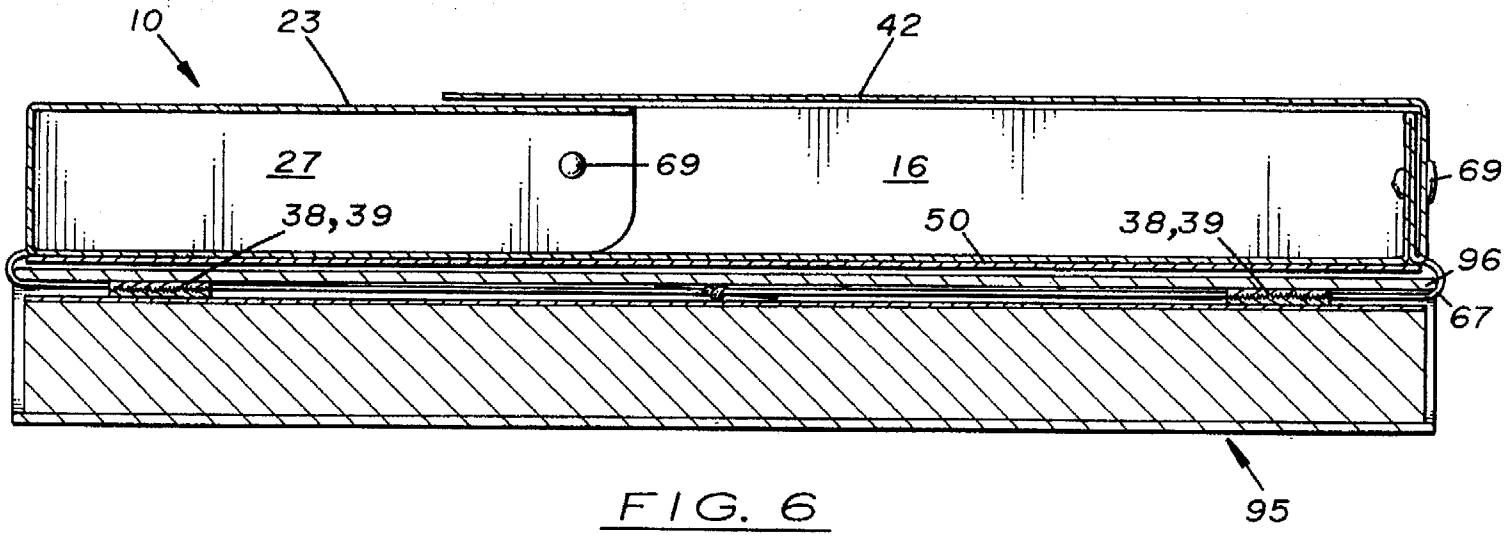
FIG. 6 is a sectional, side elevational view of the invention taken along line 6—6 in FIG. 4.

Shown in the accompanying FIGS. 1–9, there is shown an organizer, generally referred to as 10, designed to attach directly to the front or rear leaf 96 of a book. In the following disclosure, the book is shown and described as a sketchbook 95. It should be understood however, the organizer 10 may be used with any book having a front or rear leaf 96.

The organizer 10 is used to store and carry various drawing equipment, such as pencils 97 or a ruler 98 used with the sketchbook 95. More specifically, the organizer 10 includes a square or rectangular-shape container 12 with an inside support panel 50 integrally attached along one edge which provides additional support for the container 12 and helps secure the container 12 to the leaf 96. The container 12 also includes a flap member 31 which, during attachment to a book, is disposed between the inside surface of the leaf 96 and the pages therein. Attachment means are then used to selectively attach the container 12 to the leaf 96.

Figure 7:
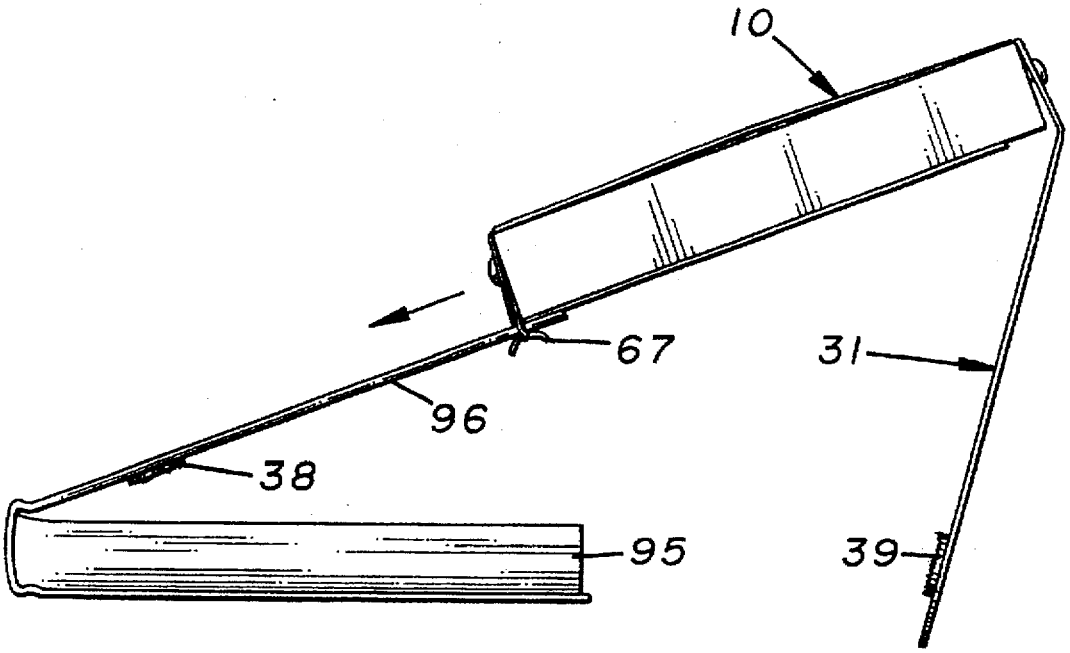
FIG. 7 is an end elevational view showing the organizer being initially attached to the leaf on a sketchbook.
Figure 8:
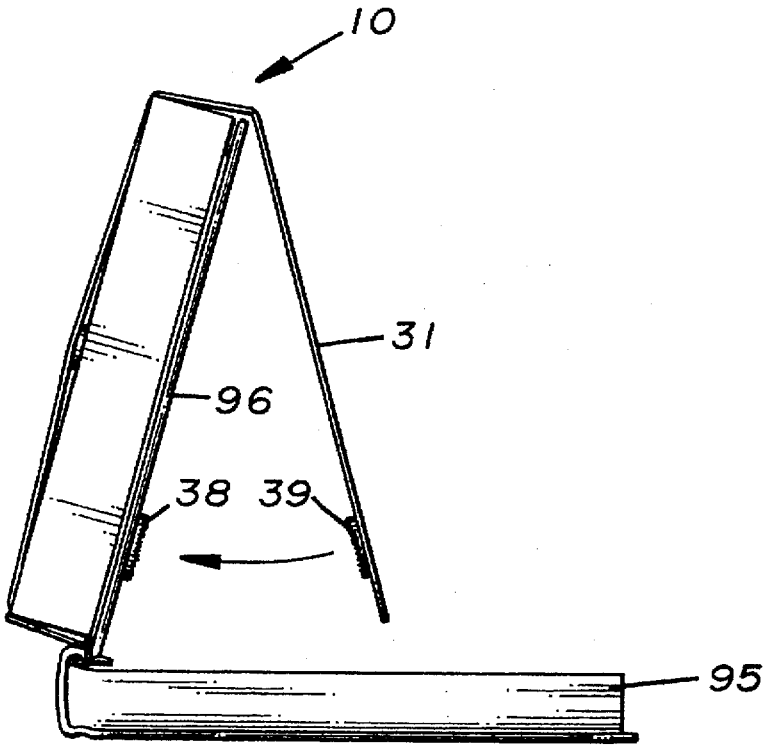
FIG. 8 is an end elevational view showing the flap member being folded around the leaf on the sketchbook and securely attached thereto by a suitable connecting means.

Structurally, the container 12 comprises two parallel first and second side walls 14, 16, two parallel top and bottom end walls 18, 19, a planar back wall 55, a short front wall 23, and planar, closable lid 42. The side walls 14, 16, the end walls 18, 19, the back wall 55, and the short front wall 23 are attached together along their adjoining edges to from a partially closed structure. As shown in FIGS. 7 and 8, the flap member 31 is integrally formed or attached to the first side wall 14. During attachment to a sketchbook 95, the flap member 31 folds under the container 12 and slides around the leaf 96 and is disposed between the inside surface of the leaf 96 and the outside surface of the first page in the sketchbook 95. Two, spaced-apart loop connector pads 38 are attached to the inside surface of the leaf 96 and two, spaced-apart hook connector pads 39 are attached to the inside surface of the flap member 31. During attachment to a sketchbook 95, the connector pads 38 and pads 39 are registered and interconnected to securely hold the flap member 31 on the inside surface of the leaf 96.

During assembly of the container 12, the inside support panel 50 is folded back under the container 12 and disposed between the outside surface of the leaf 96 and the back wall 55 of the container 12. Formed on the back wall 55 of the container 12 is a rear opening 57. The central portion of the back wall 55 cut out to form a divider 60 which extends upward inside the container 12 to divide the container 12 into two compartments. During assembly, the divider 60 is interconnected with the inside support panel 50 to interconnect the central portion 51 of the inside support panel 50 with the container 12 and provide additional support thereto.

A lid closing means is also provided so that the lid 42 may be securely closed on the container 12 during transport. In the embodiment shown herein, the lid closing means is a centrally located hook connector pad 48 attached to the inside surface of the lid 42 and a centrally located loop connector pad 49 attached to the outside surface of the short front wall 23.

Figure 9:
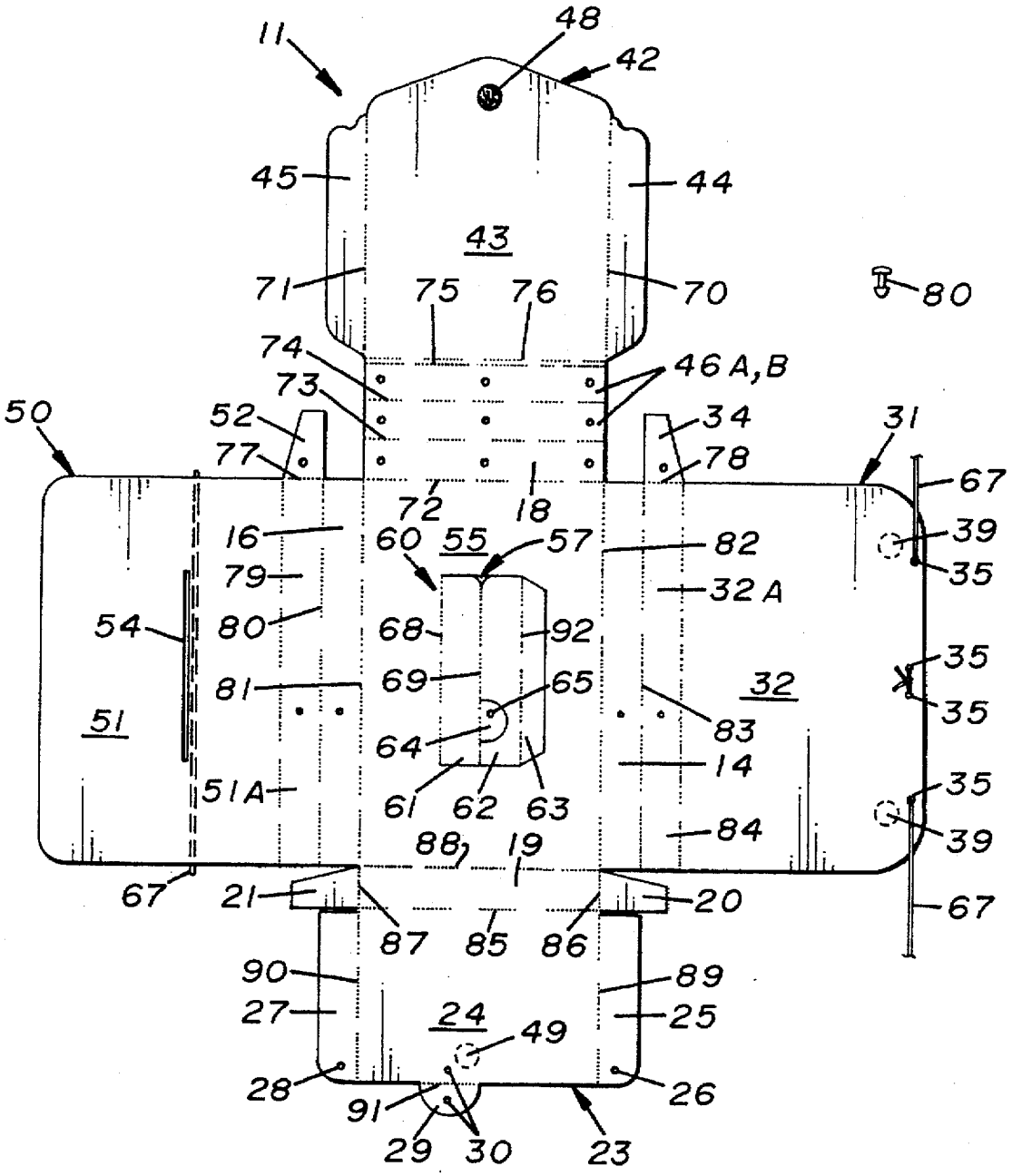
FIG. 9 is a plan view of the template made of a single sheet of durable material which is pre-cut and then folded along specific foldlines and interconnected to create a container.

An elastic strap 67 is also provided which also holds the container 12 on the leaf 96. The elastic strap 67 is arranged on the container 12 so that it loops around the inside support panel 50, the leaf 96 and the flap member 31 when the organizer 10 is aligned on the leaf 96. As shown in FIG. 9, the strap 67 may be transversely positioned over the inside support panel 50 adjacent and proximal to slot 54. When the strap 67 positioned in this manner, the divider 60 acts as a stop surface which prevents the strap 67 from disengaging from the inside support panel 50. In an alternative arrangement shown in FIG. 9, the strap 67 may be cut and disposed through holes 35 formed near the extending edge of the flap member 31. When used in this alternative arrangement, the organizer 10 may be used on larger books to prevent the organizer 10 from moving over the leaf 96.

As shown in FIG. 9, the organizer 11 is constructed from a template 11 shown in a horizontal position with its inside facing upward. The template 11 is formed from a single sheet of durable material, such as thick paper or vinyl. The container's short front wall 23 is formed by folding side walls 25, 27 upward approximately 90 degrees along foldlines 89, 90 respectively. The central panel 24 on the short front wall 23 is then folded upward approximately 90 degrees along foldline 85 and then folded again approximately 90 degrees along foldline 88 so that the extending edge of the short front wall is disposed directly over the back wall 55. Tab 29 is folded inward approximately 180 degrees along foldline 91.

The first side wall 14 is folded upward approximately 90 degrees along foldline 82. The extension area 32A is then folded downward approximately 180 degrees along foldline 83. Tab 34 is folded inward approximately 90 degrees along foldline 78. The central panel 32 is then folded downward approximately 180 degrees to dispose the central panel 32 under the back wall 55.

The second side wall 16 is folded upward approximately 90 degrees along foldline 81. The extension area 51A is then folded downward approximately 180 degrees along foldline 80. Tab 52 is folded inward approximately 90 degrees along foldline 77. The central portion 51 is then folded downward approximately 180 degrees to dispose the inside support panel 50 directly under the back wall 55.

To assemble the divider 60, the first vertical wall 61 is folded upward approximately 180 degrees along foldline 68 while the second vertical wall 62 is folded downward approximately 180 degrees along foldline 69. When the central portion 51 of the inside support panel 50 is disposed under the back wall 55, the extending lip 63 on the divider 60 is then inserted into the longitudinally aligned slot 54 formed on the central portion 51 to hold the divider 60 in a vertical alignment inside the container 12.

The upper end wall 18 is folded upward approximately 90 degrees along foldline 72 while the intermediate end wall 46A is folded downward approximately 180 degrees along foldline 73. The outer end wall 46B is then folded upward approximately 180 degrees along foldline 74. The central panel 43 is then folded upward and over the back wall 55 along foldlines 75, 76 to dispose the central panel 43 directly over the back wall 55. The opposite side walls 44,45 are then folded downward approximately 90 degrees along foldlines 70 and 71, respectively.

During assembly, suitable connectors, such as nylon push-in fasteners 80, are used to interconnect the adjacent end walls 18, 46A, 46B, the adjacent side walls 14 and 32A, and the adjacent side walls 16 and 51A. Suitable fasteners 80 are also used to interconnect the side walls 25, 27 with the adjacent side walls 16, 51A and 14, 32A, respectively. Suitable fasteners 80 are also used to interconnect tabs 34, 52 with end walls 18, 46A and 46B. Suitable connectors 80 are also used to interconnect tabs 29 and 64.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An organizer for a book having at least one leaf, said organizer comprising:

a. a container;

b. a closeable lid attached to said container;

c. a flap member attached to said container, said flap member capable of being inserted inside and adjacent to the leaf;

d. a flap member attachment means capable of selectively attaching said flap member to said leaf;

e. an inside support member attached to said container, said inside support member capable of being disposed between said container and said leaf; and, f. a strap attached around said inside support member and said leaf to hold said container on said book.

2. An organizer as recited in claim 1, wherein said container includes two parallel side walls, two parallel end walls, a back wall, and a short front wall, said side walls, said end wall, said back wall and said short front wall being jointed together at their adjacent surfaces.

3. An organizer as recited in claim 2, further including a divider disposed inside said container to create two separate compartments inside said container.

4. An organizer as recited in claim 1, wherein said container, said lid, said flap member, said inside support member are integrally attached and formed from a template.

5. An organizer as recited in claim 4 wherein said template is made of thin, durable material.

6. An organizer as recited in claim 5, wherein said thin durable material is vinyl.

* * * * *